US006805253B1

(12) United States Patent
Nicholson et al.

(10) Patent No.: US 6,805,253 B1
(45) Date of Patent: Oct. 19, 2004

(54) PROTECTIVE CASING

(75) Inventors: Graham Nicholson, Lancs (GB); John Willetts, Lancs (GB); Arthur R. Mableson, Southampton (GB); Colin J. Weston, Hants (GB)

(73) Assignee: British Nuclear Fuels PLC, Cheshire (GB)

( * ) Notice: Subject to any disclaimer, the term of this patent is extended or adjusted under 35 U.S.C. 154(b) by 178 days.

(21) Appl. No.: 09/673,771

(22) PCT Filed: Apr. 16, 1999

(86) PCT No.: PCT/GB99/01180

§ 371 (c)(1),
(2), (4) Date: Nov. 30, 2000

(87) PCT Pub. No.: WO99/54887

PCT Pub. Date: Oct. 28, 1999

(30) Foreign Application Priority Data

Apr. 21, 1998 (GB) ..... 9808242

(51) Int. Cl.[7] ..... B65D 6/00; B65D 8/00

(52) U.S. Cl. ..... 220/4.05; 220/4.07; 220/4.21; 220/4.24; 220/62.19; 220/62.22

(58) Field of Search ..... 220/4.05, 4.07, 220/4.21, 4.24, 62.19, 62.22; 206/521, 446

(56) References Cited

U.S. PATENT DOCUMENTS

| | | | | |
|---|---|---|---|---|
| 3,412,891 A | * | 11/1968 | Bastone et al. | 220/62.19 X |
| 3,490,638 A | * | 1/1970 | Elliott et al. | 220/5 |
| 3,598,275 A | * | 8/1971 | Francols | 220/62.22 X |
| 3,935,467 A | | 1/1976 | Gablin | |
| 4,100,860 A | | 7/1978 | Gablin et al. | |
| 4,562,857 A | * | 1/1986 | Ball | 220/4.21 X |
| 4,747,512 A | | 5/1988 | Lo | |
| 4,811,858 A | * | 3/1989 | Augur | 220/4.21 X |
| 5,695,090 A | * | 12/1997 | Burdick | 206/521 X |
| 6,119,861 A | * | 9/2000 | Schneider | 206/446 X |

FOREIGN PATENT DOCUMENTS

| | | |
|---|---|---|
| DE | 22 40 022 | 2/1973 |
| DE | 23 11 162 | 9/1974 |
| FR | 2 575 320 | 6/1986 |
| GB | 1 527 937 | 10/1978 |
| GB | 1 545 527 | 5/1979 |
| GB | 2 171 632 | 9/1986 |
| GB | 2 180 220 | 3/1987 |
| WO | 94/04434 | 3/1994 |

* cited by examiner

*Primary Examiner*—Jes F. Pascua
(74) *Attorney, Agent, or Firm*—Nixon & Vanderhye P.C.

(57) ABSTRACT

A casing for the protection of an article contained within the casing is described, the protective casing comprising: at least two casing members which are assemblable to constitute a casing having an internal volume to receive the article, each of said at least two casing members comprising: an outer skin of fiber reinforced plastics material having a plurality of layers of reinforcing fibers in a plastics material matrix; an inner skin of fiber reinforced plastics material having a plurality of layers of reinforcing fibers in a plastics material matrix; a filling of a low density core material in a space between the outer and inner skin members; sealing means disposed in the joint face between said at least two casing members; and fastener means to hold said at least two members together.

21 Claims, 11 Drawing Sheets

PROTECTIVE CASING

This application is the US national phase of international application PCT/GB99/01180, filed in English on 16 Apr. 1999 which designated the US. PCT/GB99/01180 claims priority to GB Application No. 980824.3 filed 21 Apr. 1998. The entire contents of these applications are incorporated herein by reference.

BACKGROUND OF THE INVENTION

1. Field of the Invention

The present invention relates to a removable protective casing for the protection of heavy and possibly hazardous articles during storage and/or transit. The protective casing is suitable for the protection of heavy cylinders containing gaseous substances and particularly, though not exclusively, for the protection of cylinders of uranium hexafluoride in transit.

2. Discussion of Prior Art

Gaseous uranium hexafluoride is the primary material from which nuclear fuels are made and is transported around the world in pressurised cylinders which are currently protected by a so-called "overpack". The present protective overpack comprises stainless steel inner and outer skins having a filling of a phenolic resin or polyurethane foam in the intervening space between the skins. Due to the hazardous nature of the material being transported, the overpacks have to withstand rigorous tests set by regulatory bodies to ensure integrity if they are dropped from a height during handling for example and have also to provide a heat barrier and watertight protection for the contained cylinder. A 30" diameter cylinder full of uranium hexafluoride and having the overpack described above may weigh up to 4000 kg. The overpack and cylinder must survive being dropped from 9m without damage to the cylinder. However, in some recent tests, deformation of the cylinder skirt and consequent damage to the cylinder valve through which the uranium hexafluoride is filled and removed has occurred. This has necessitated a complex, costly and difficult to fit valve protection member being added to the existing overpacks. The problems are exacerbated by corrosion of the overpack metal skins which allows the interior foam to become saturated with water making the overpacks even heavier and the absorbed water further increasing the corrosion rate in addition to that caused by the phenolic resin itself as the packs have to stay outside under virtually all climatic conditions. To further strengthen the present overpack, more metal components have been added which degrades the fire resistance due to increased thermal conductivity.

SUMMARY OF THE INVENTION

It is an object of the present invention to provide a protective casing which is lighter in weight, more durable and more easily repaired than the presently known overpack. It is a further object to provide a protective casing where no additional components to protect the valve of a contained cylinder are required. It is a yet further object to provide a protective casing having improved resistance to corrosion and weathering. It is a still further object to provide a protective casing having improved fire resistance.

According to the present invention there is provided a casing for the protection of an article contained within the casing, the protective casing comprising: at least two casing members which are assemblable to constitute a casing having an internal volume to receive the article, each of said at least two casing members comprising; an outer skin of fiber reinforced plastics material having a plurality of layers of reinforcing fibers in a plastics material matrix; an inner skin of fiber reinforced plastics material having a plurality of layers of reinforcing fibers in a plastics material matrix; a filling of a low density core material in a space between the outer and inner skin members; sealing means disposed in the joint face between said at least two casing members; and fastener means to hold said at least two members together.

The filling of low density core material is to provide an increase in the section modulus and to provide a crush zone in the event of impact.

Preferably, there are two casing members of generally semi-cylindrical form and the assembled casing may be of generally cylindrical form.

The casing members may not necessarily be of identical shape or construction.

Preferably, the outer casing skin comprises a plurality of layers of non-woven glass cloth and optionally aramid fiber layers having a matrix of a urethane acrylate, vinyl ester resin and/or polyester resin for example.

Preferably, the inner casing skin comprises a plurality of layers of non-woven glass cloth layers having a matrix of a polyester resin for example or the resin used in the outer casing skin.

However, other resin matrices such as epoxy or phenolic may be used in some applications.

The non-woven cloths may be 0°/90° or 45°/45° or may be a mixture of both for example.

Woven cloths, continuous filament or chopped-strand mat may also be used in some applications.

The different fiber layers may be arranged alternately or in groups of two for example.

The inner and outer skins may each have an overall thickness in the range from about 2 mm to about 25 mm.

The outer skin may also incorporate external ribbing to increase strength and stiffness of the casing members. The recesses in the external ribbing may also provide convenient protection for fasteners used to lock the casing members together.

The low density core material between the inner and outer skins may be a PVC or polyurethane foam material or timber-based such as cork or balsa wood for example. In the case of foam, the core may have fillers such as glass spheres for example to reduce the density of the foam.

A foam core in the region of the joint faces between the casing members may be a high density syntactic foam for example to increase the strength in this region.

Alternatively, another material such as wood may be used in this region if necessary.

The foam may itself be reinforced with various fillers such as clay, glass or ceramics for example. Glass fillers may also incorporate neutron or radiation shielding materials.

The foam may be introduced in the form of a liquid and foamed in-situ or may be in sheet form, curved by the application of heat and bonded to the facing surfaces of the inner and outer skins by an adhesive. Alternatively, the foam core may be cut from block material.

The thickness of the foam core may lie in the range from about 10 mm to about 200 mm.

The inner surface of the outer skin may have reinforcements bonded or otherwise incorporated to allow for the attachment of components by bolting, for example, to the outside of the casing. Such reinforcements may comprise materials such as wood or metals such as steel for example.

Such components may include cradle members to allow for the convenient stacking and handling of the casing and contained cylinders during transportation and storage.

Corners of the protective casing may also further include reinforcing members such as additional layers of fibers and resin and/or embedded metal members. However, in order to maximise the fire resistance of the casing according to the present invention, the inclusion of metal members is desirably reduced to a minimum.

The faces of the casing members which constitute the joints therebetween may be provided with seal members to prevent ingress of water.

The joint faces may also be provided with intumescent seals which expand when subjected to heat to further protect the enclosed article.

The outside of the casing in the joint region for example may be provided with an additional protective layer comprising, for example, a coating of a rubber to further improve abrasion and impact resistance.

It has been found that the strength of the protective casing according to the present invention is sufficient to meet all the test procedures for cylinders of uranium hexafluoride for example at a significantly lighter overall weight than the presently used overpacks.

The method of manufacture may be by resin transfer moulding or resin infusion. Resin infusion and resin transfer (RTM) are processes where resin is injected into a fiber filled cavity between two mould surfaces.

Alternatively, the method of manufacture of protective casings according to the present invention may be by conventional laying up of layers of reinforcing fibers sequentially in a mould and impregnating with the appropriate resin followed by curing for example.

Casings of the present invention may be easily repaired unlike known overpacks for example.

BRIEF DESCRIPTION OF THE DRAWINGS

In order that the present invention may be more fully understood, examples of protective casings for the protection of uranium hexafluoride cylinders will be described by way of illustration only with reference to the accompanying drawings, of which.

DETAILED DISCUSSION OF EMBODIMENTS

Figure 1:
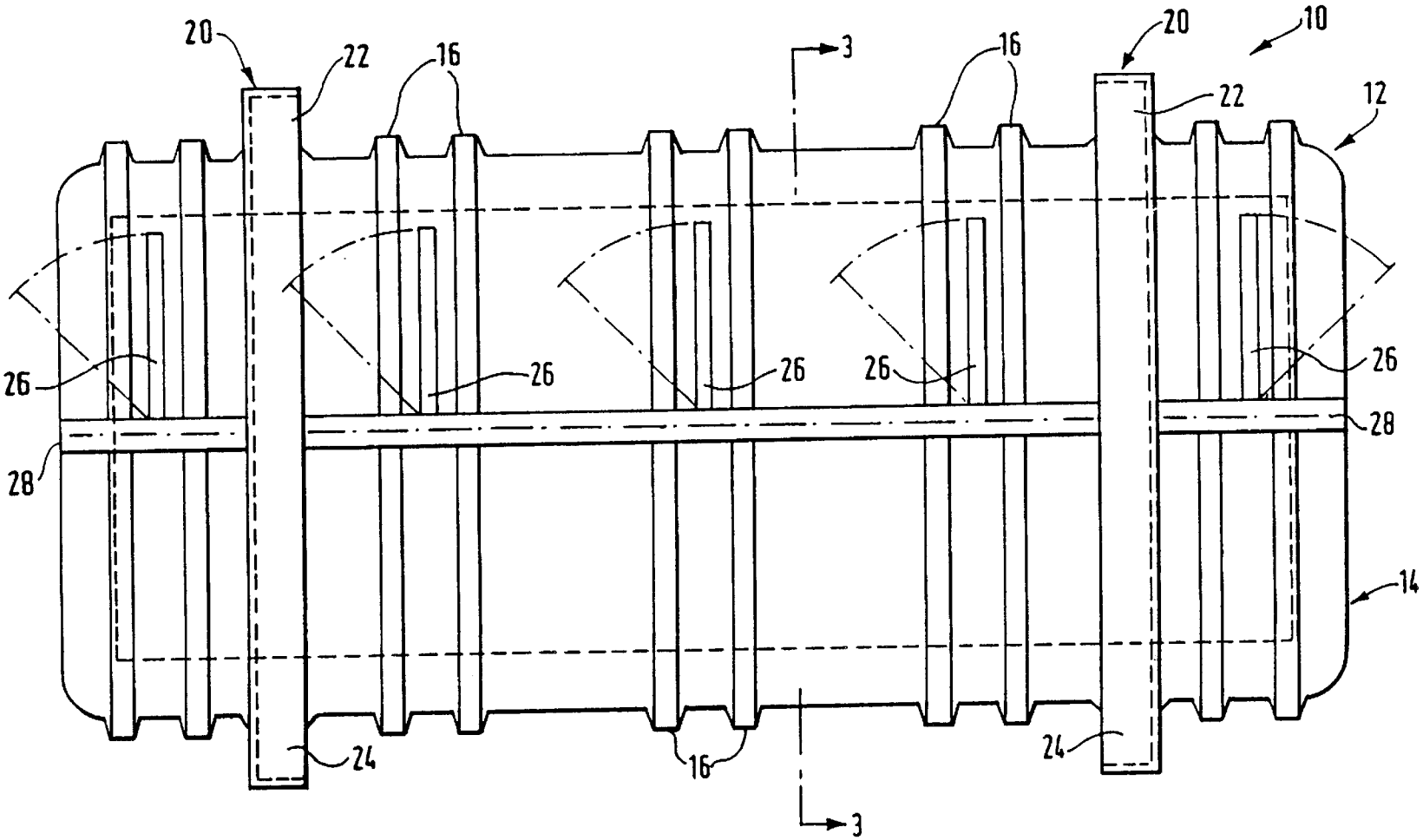
FIG. 1 shows a side view of a protective casing according to the present invention.
Figure 2:
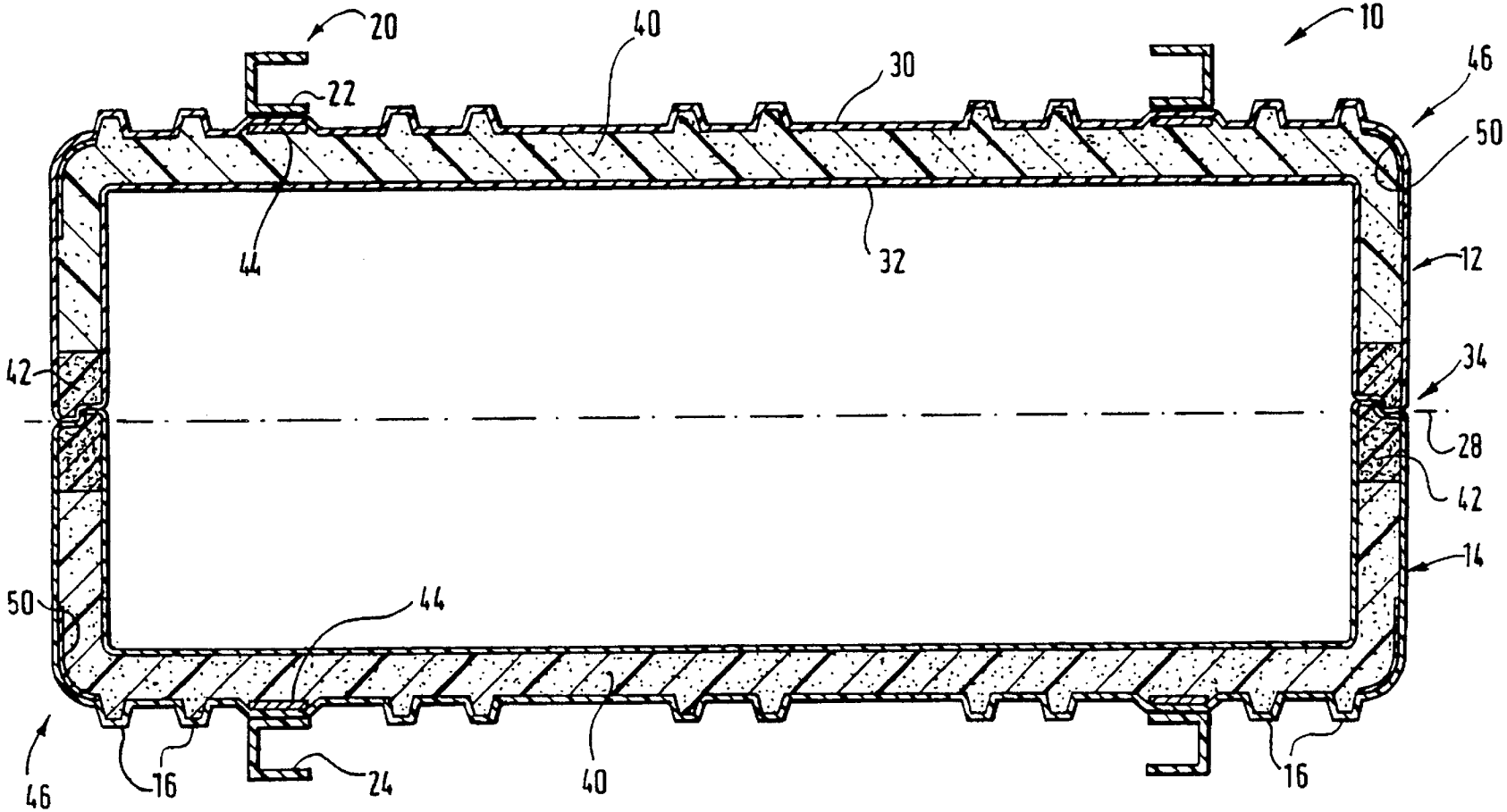
FIG. 2 shows a vertical cross section through the casing of FIG. 1.

Referring now to the drawings and where the same features are denoted by common reference numerals. A protective casing according to the present invention is shown generally at 10. The casing 10 is generally cylindrical in shape and comprises two generally semi-cylindrical casing half shells 12, 14; the outer surfaces of which are provided with a plurality of circumferential, moulded-in strengthening ribs 16; two rectangular stacking/stabilisation cradles 20 which are formed in two halves 22, 24; and, a plurality of fastening catches 26, the positions only of which are shown in FIG. 1 and which secure the two casing halves 12, 14 together along a joint line 28 to form an interior volume to receive an article to be protected (see FIG. 7). FIG. 2 shows a vertical cross section through the casing of FIG. 1. Each casing half comprises an outer skin 30 and an inner skin 32 which are bonded together in the joint face region 34 at the joint line 28 by layers of fiber cloth impregnated with resin. The skins 30, 32 each comprise a plurality of layers of fiber cloth overlaid one upon the other and impregnated with a plastics material resin. In the embodiment shown, the outer skin 30 comprises:

- a gelcoat and 450 csm;
  - 8 layers of 0°/90° non-woven glass reinforcement, each layer alternating with;
  - 8 layers of ±45° non-woven aramid reinforcement;
  - with a polyester resin matrix.
- The inner skin 32 comprises:
  - 5 layers of 0°/90° non-woven glass reinforcement, each layer alternating with;
  - 5 layers of ±45° non-woven glass reinforcement; and a polyester resin matrix; and
  - 450 csm and gelcoat.

Figure 3:
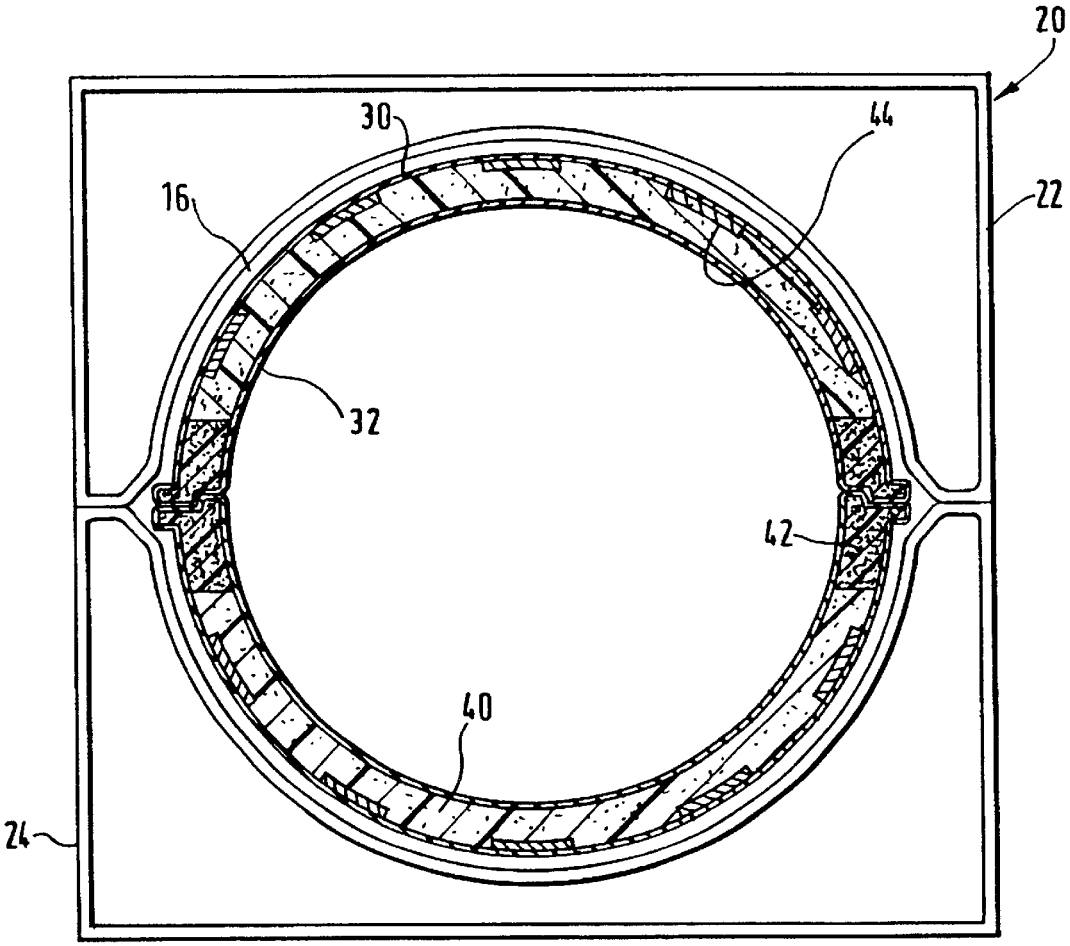
FIG. 3 shows a cross section on the line 3—3 of FIG. 1.
Figure 4:
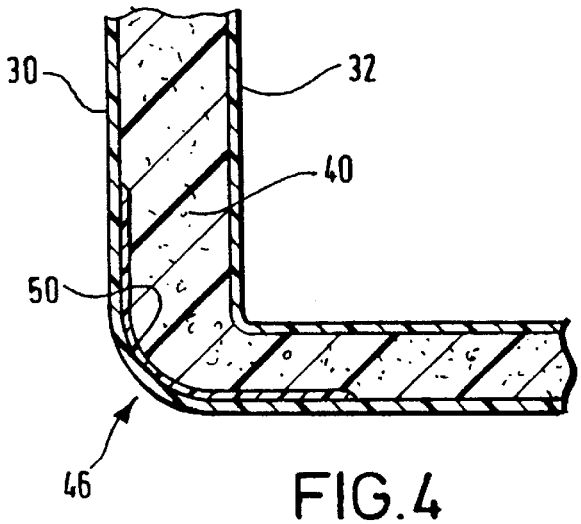
FIG. 4 shows a corner region in greater detail as shown in FIG. 2.
Figure 5:
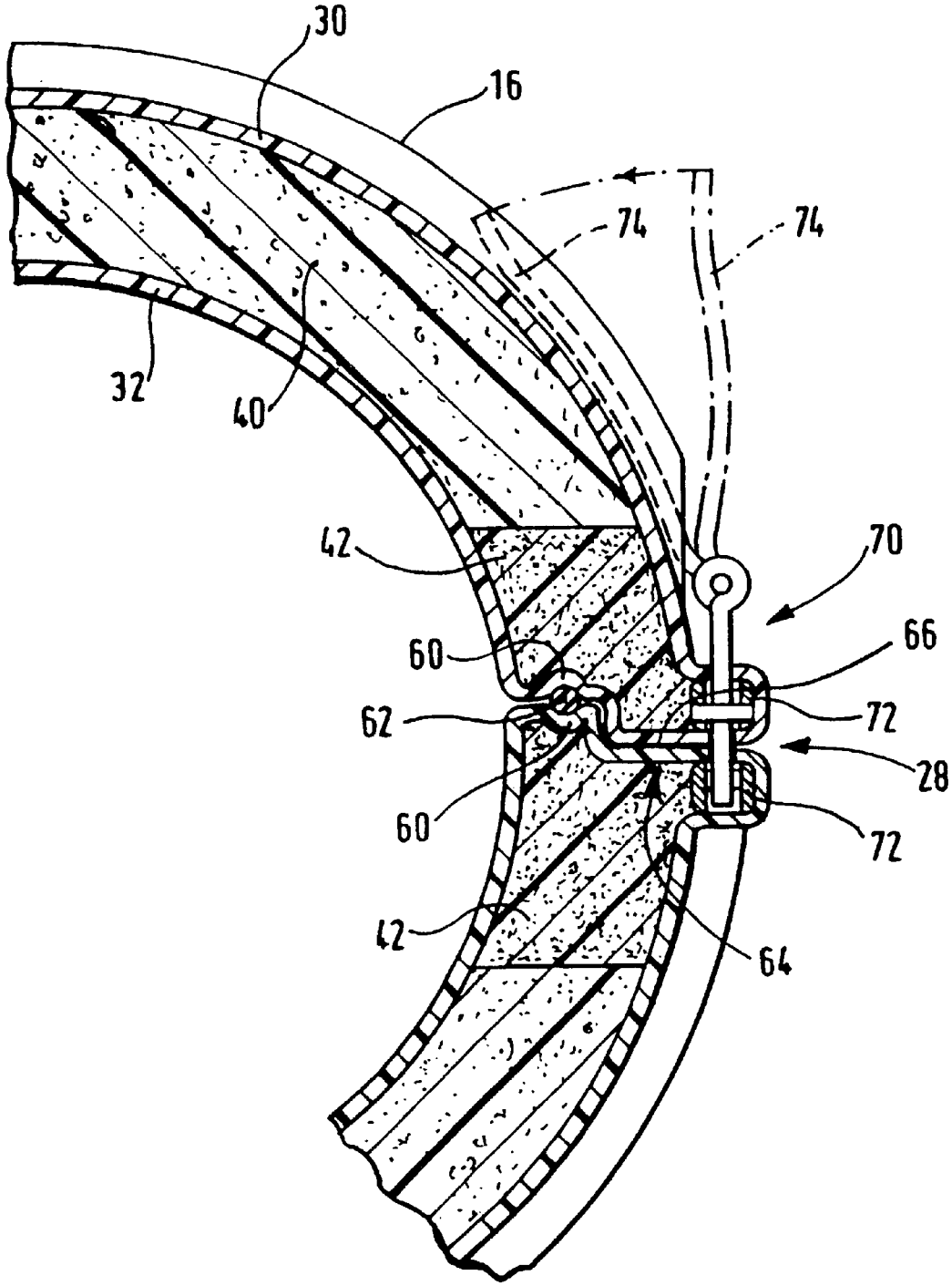
FIG. 5 shows a cross section through a region having a fastener to join casing halves together.
Figure 6:
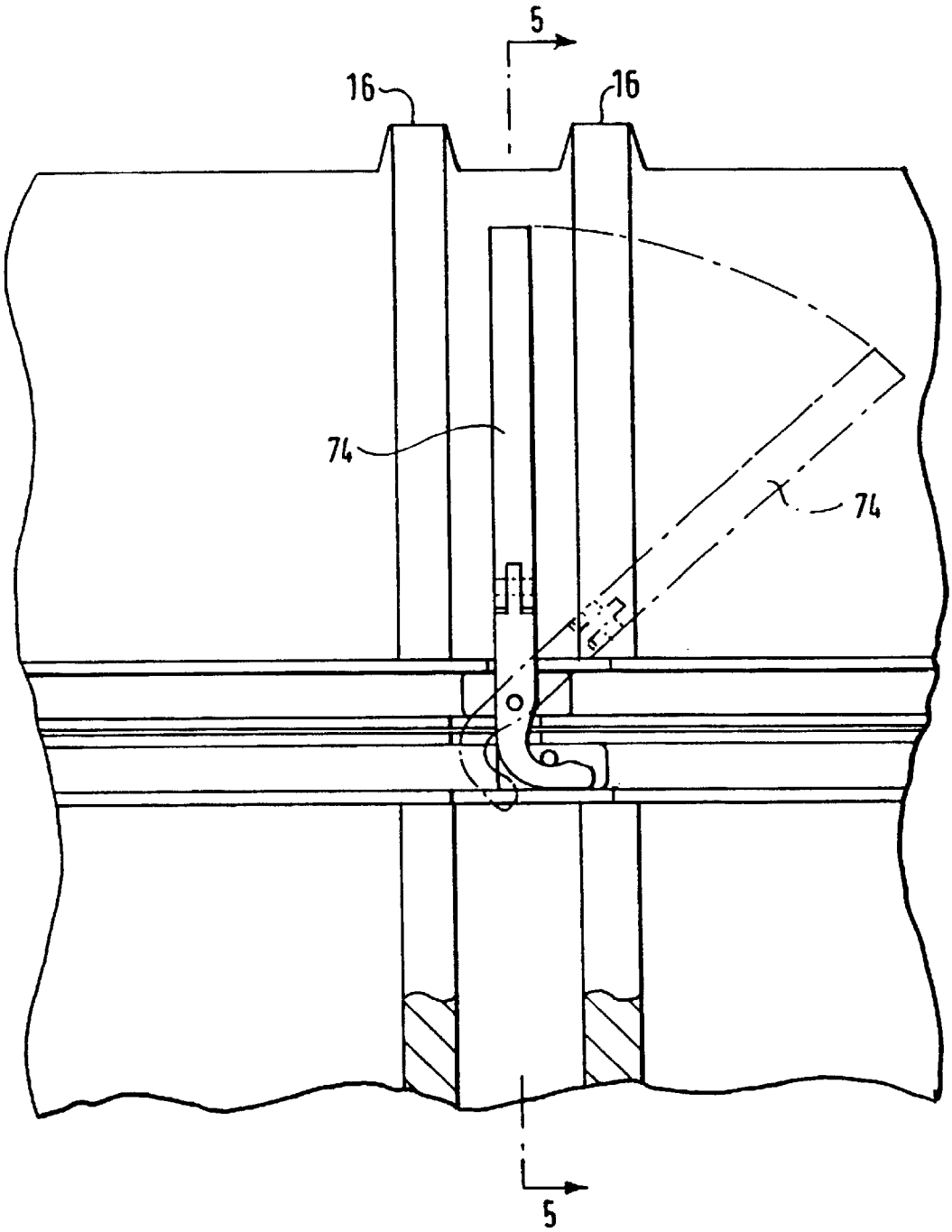
FIG. 6 shows the region of FIG. 5 at 90° thereto.

Between the inner and outer skins is a core 40 of PVC foam extending over the main area of the casing with a core of polyurethane syntactic foam 42 adjacent the joint face region. Bonded onto the inner surface of the outer skin 30 in one of the stiffening ribs 16 are metal plates 44 which are drilled and tapped to receive bolts (not shown) to connect the cradle elements 22, 24 thereto. The corner regions 46 of the two casing halves are provided with additional layers of reinforcing fibers 50 to strengthen this region against dropping impact. FIG. 3 shows an end view and partial cross section of the protective casing according to the present invention clearly showing the support cradles 20 which are also of fiber reinforced plastics construction. As may be seen in more detail in FIGS. 5 and 6, the two casing halves are joined together at a joint line 28 by mutually co-operating features on the mating faces. A groove 60 is formed around the periphery of both joint faces to receive a seal bead 62 to keep water out of the casing.

At an outer portion 64 around the joint area, there is an intumescent seal 66 which expands in the case of fire or excessive heat to protect the interior of the casing. The two casing halves are fixed together by over-center fasteners 70 at a plurality of positions 26 around the joint face periphery, the fastener bodies 72 being held within the fiber reinforced resin moulding at the edge. The handle 74 of the fasteners 70 are arranged to lie below the surface of the ribs 16 for protection during transit The stronger, high-density syntactic foam 42 in the joint face region increases rigidity and strength.

Figure 7:
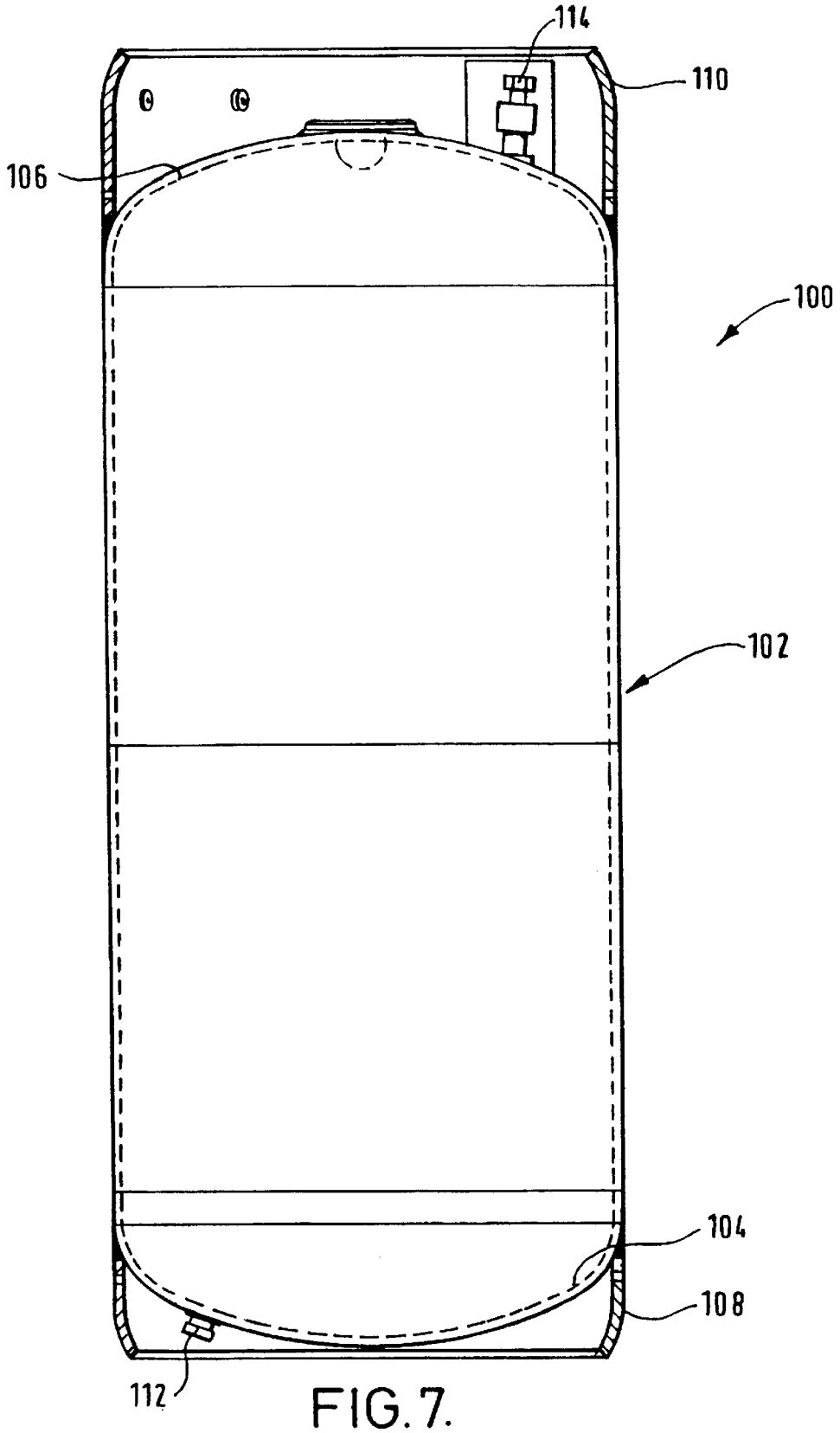
FIG. 7 shows a partially sectioned elevation of a cylinder for transporting and storing uranium hexafluoride.
Figure 8:
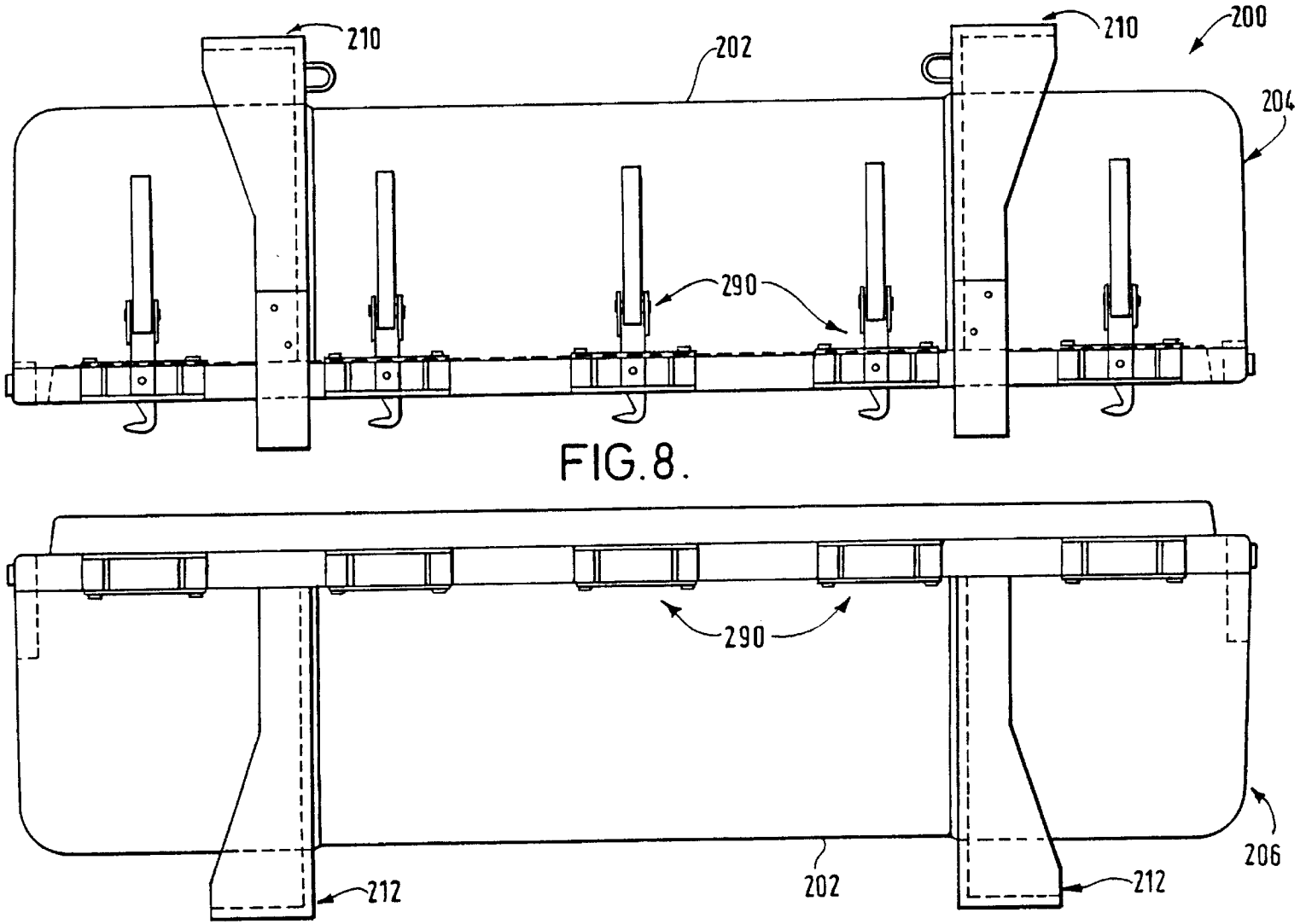
FIG. 8 shows a side view of a second embodiment of a protective casing according to the present invention wherein the two casing halves are shown separated.
Figure 9:
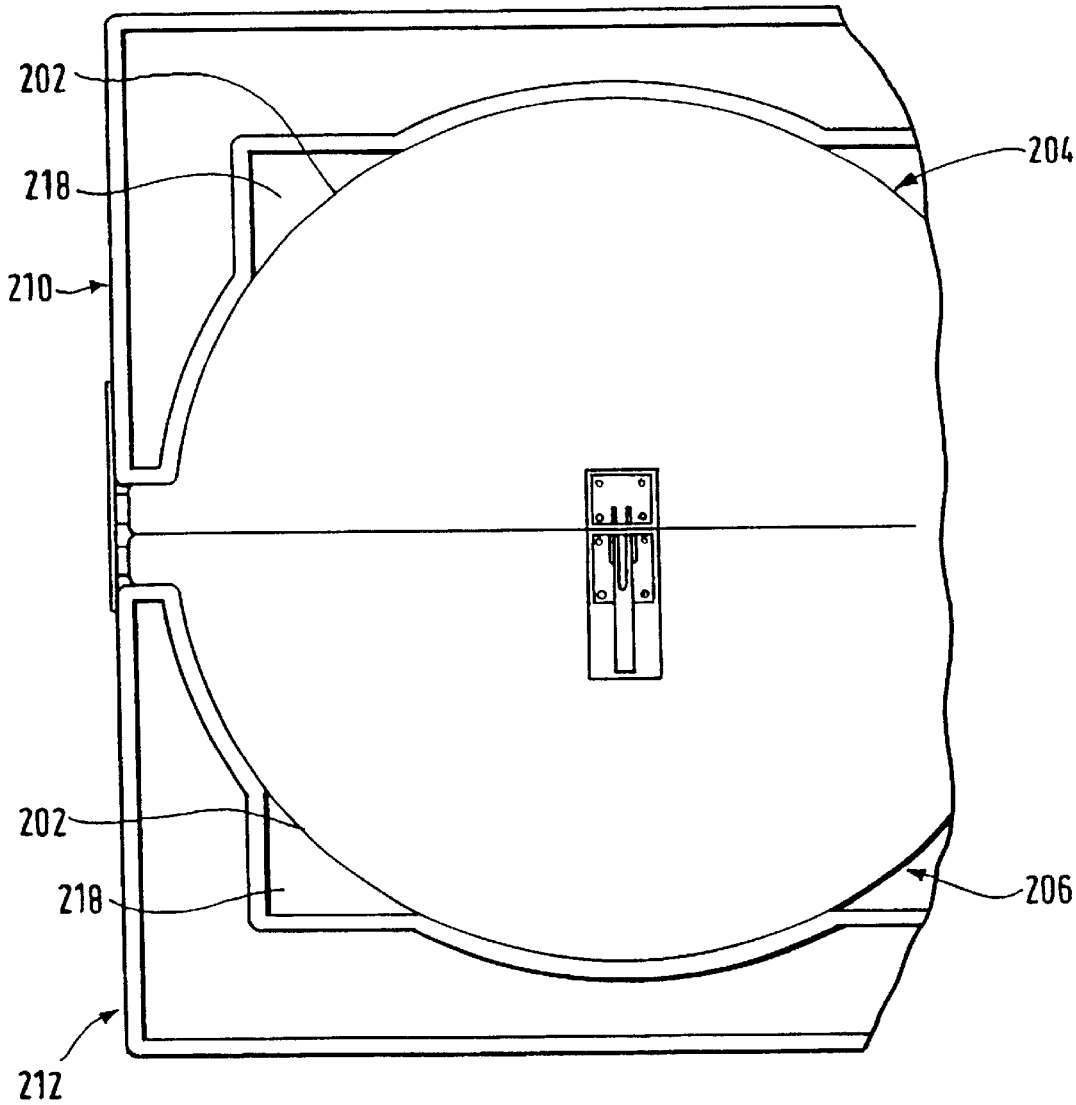
FIG. 9 shows a partial end view of the casing of FIG. 8 with the two casing halves joined together.
Figure 10:
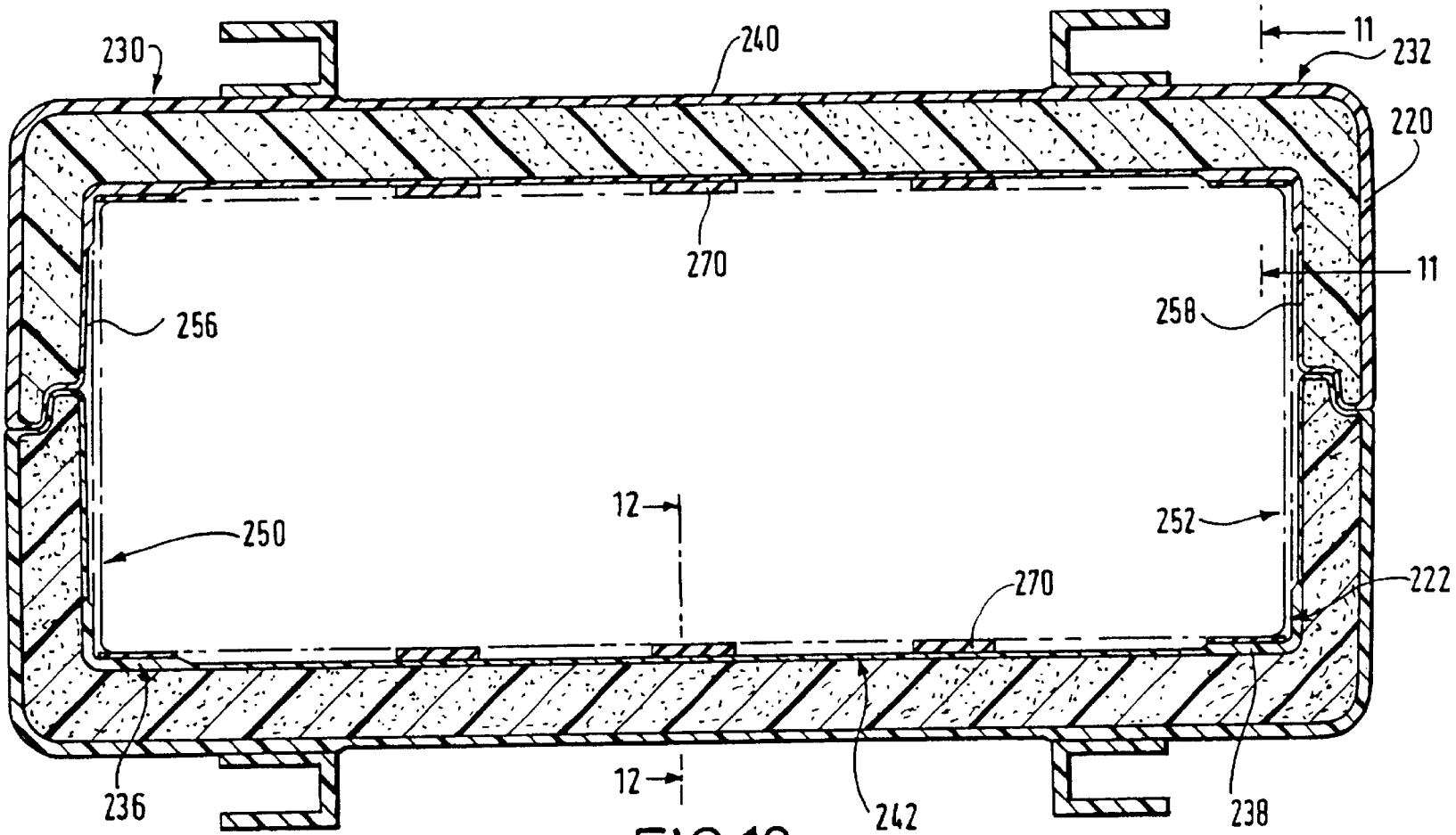
FIG. 10 shows a cross section of the casing of FIG. 8 through a vertical plane with the two halves joined together.
Figure 12:
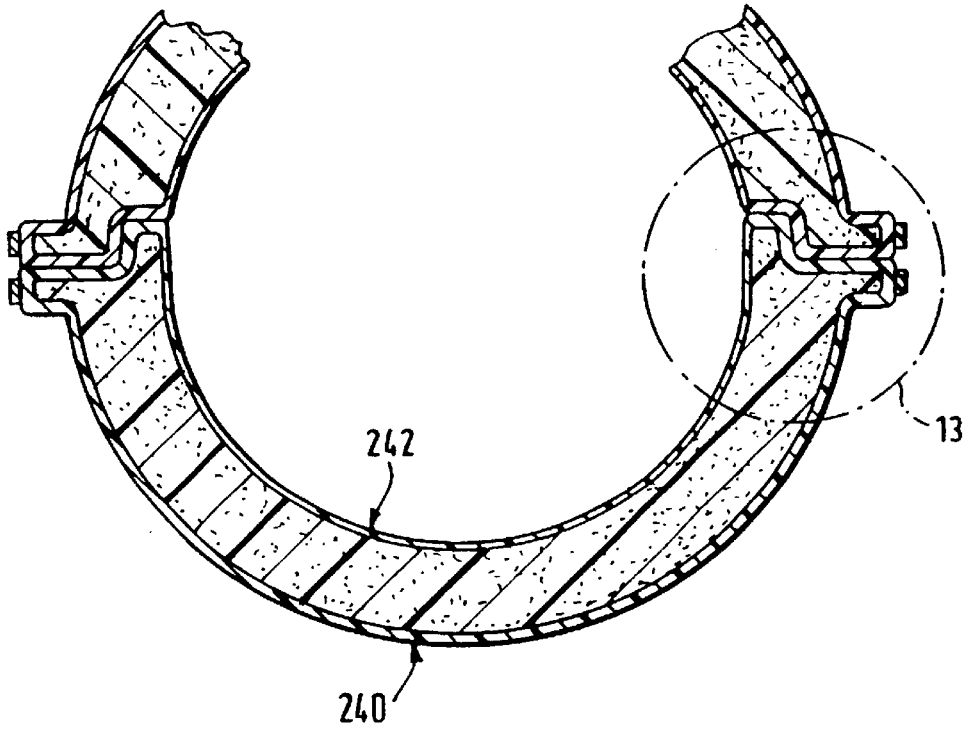
FIG. 12 shows a cross section on the line 12—12 of FIG. 10.
Figure 11:
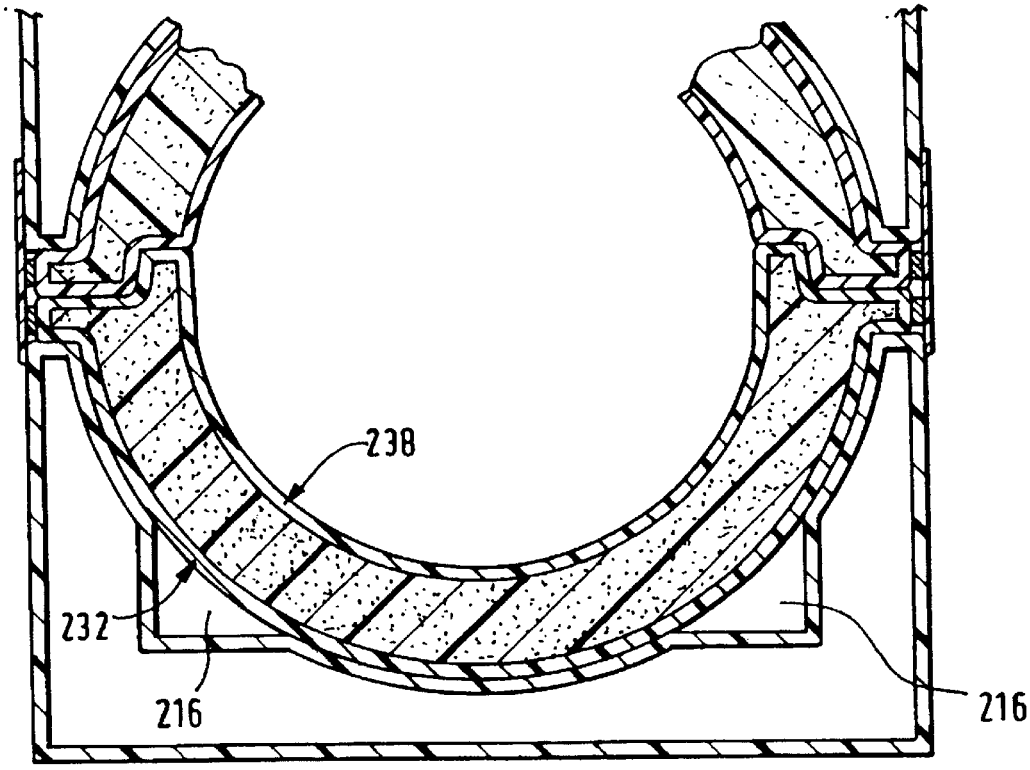
FIG. 11 shows a cross section on the line 11—11 of FIG. 10.
Figure 13:
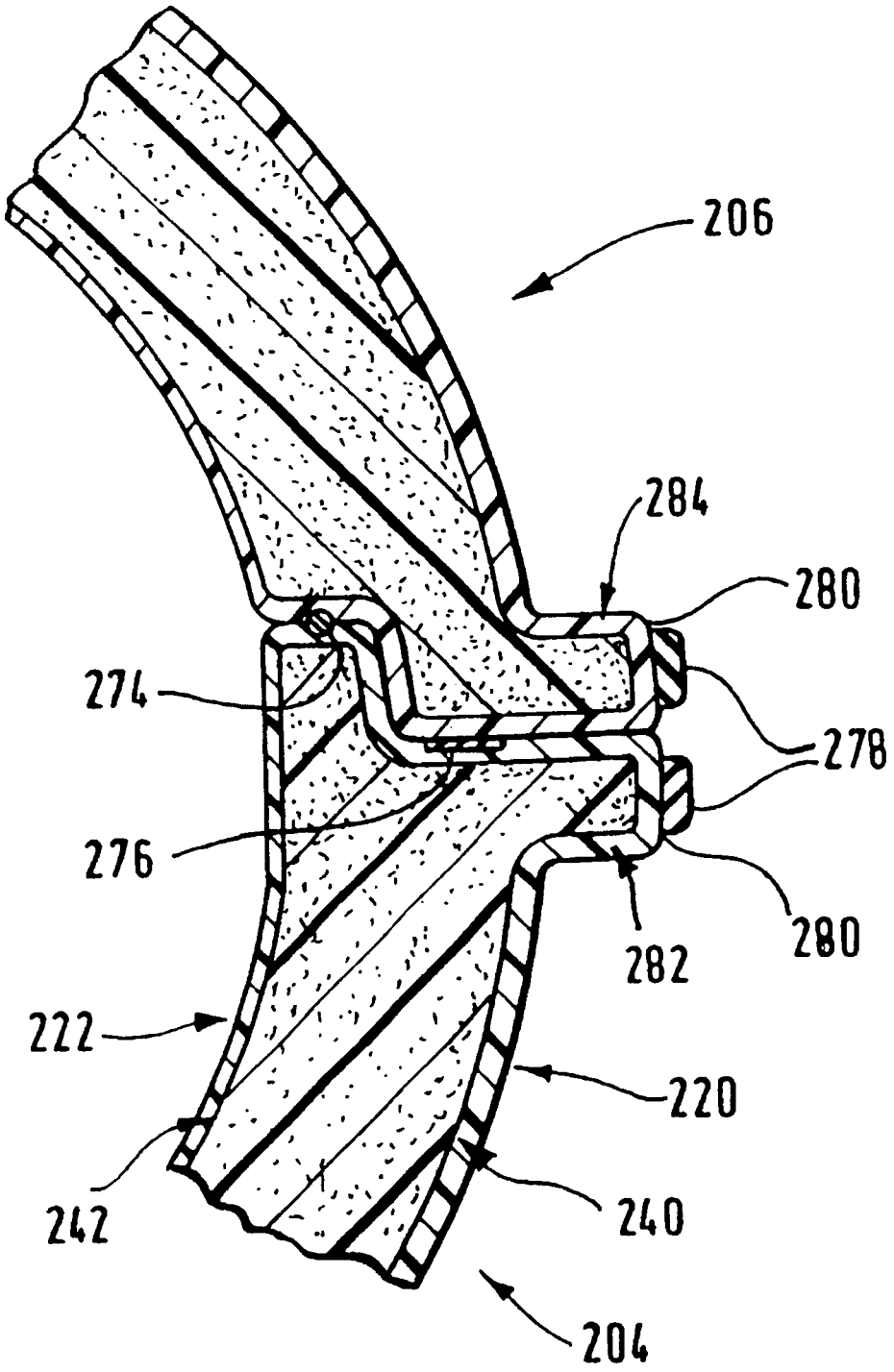
FIG. 13 which shows the detail 13 of FIG. 12 in more detail.

FIG. 7 shows an elevation of a uranium hexafluoride cylinder 100. The cylinder comprises a welded metal shell 102; a closure 104, 106 at each end and two metal skirts 108, 110, the skirt 108 enabling the cylinder to be stood up on end and also protecting a plug 112. The skirt 110 is primarily to protect a valve 114 through which the cylinder 100 is both filled with uranium hexafluoride and through which the same is extracted. If the valve 114 is damaged or knocked off, the cylinder contents may escape.

With existing protective casings, recent occurrences have shown the skirt 110 to be deformed after dropping of the cylinder in the casing such that the skirt 110 has impinged on the valve 114 causing deformation thereof and a potentially dangerous situation. This has necessitated a complex, expensive and difficult to fit valve protection member (not shown) to be fitted to these cylinders when used with existing overpacks to obviate damage to the valve.

Referring now to FIGS. 8 to 13 and where a second embodiment of a protective casing is shown generally at 200. The second embodiment has a smooth 202 as opposed to ribbed outer surface. The casing 200 has two half-casing members 204, 206. Each half-casing member has fiber-reinforced plastics material cradle members 210, 212 bonded thereto. Spaces 218 are provided between the casing surface 202 and the cradle members 210, 212 for the insertion of lifting forks (not shown) for example. The outer skin 220 and inner skin 222 comprise a plurality of layers of glass reinforcing cloths impregnated with a plastics resin material in a similar manner to the first embodiment described above. However, in this case the casing skins are produced by resin transfer moulding. In this second embodiment, the end portions 230, 232 of the outer casing skin 220 and the end portions 236, 238 of the inner casing skin 222 having thicker sections due to additional layers of glass reinforcement than the central section 240, 242 respectively. The radially directed end faces 250, 252 of the inner skin 222 have recesses 256, 258 to provide further protection for a contained cylinder (not shown) similar to that shown in FIG. 7 below. The core 260 comprises a CNC cut high density polyurethane foam. Elastomeric rings 270 are provided around the inner periphery of the inner skin 222 for seating a contained cylinder. In the joint face region as shown in more detail in FIG. 13, there is provided an elastomeric seal 274, an intumescent seal 276 and rubber buffers 278 around the outer surface 280 of the lips 282, 284 of the casing members 204, 206. Catches 290 are provided along the edges of the casing members and at the ends thereof. The catches 290 comprise over center or threaded clamping mechanisms.

The protective casings according to the present invention meets all regulatory body tests and do not require the valve protection member to be used thus saving cost and resources.

What is claimed is:

1. A casing for the protection of an article contained within the casing, the protective casing comprising:

at least two casing members which are assemblable to constitute a casing having an internal volume to receive the article, each of said at least two casing members comprising;

an outer skin of fiber reinforced plastics material having a plurality of layers of reinforcing fibers in a plastics material matrix, said layers overlaid one upon the other;

an inner skin of fiber reinforced plastics material having a plurality of layers of reinforcing fibers in a plastics material matrix, said layers overlaid one upon the other;

a filling of a low density core material in a space between the outer and inner skins;

sealing means disposed in the joint face between said at least two casing members; and fastener means to hold said at least two members together.

2. A protective casing according to claim 1 wherein the outer casing skin comprises a plurality of layers of fiber reinforcement selected from the group comprising: woven glass cloth; non-woven glass cloth; glass fiber chopped strand mat; and aramid fiber.

3. A protective casing according to claim 1 wherein the inner casing skin comprises a plurality of layers of non-woven glass cloth layers having a matrix of a plastics material.

4. A protective casing according to claim 1 wherein the outer skin also incorporates external moulded-in circumferential ribbing.

5. A protective casing according to claim 4 wherein the internal recesses in the external ribbing have metal plates bonded therein to receive fastening screws.

6. A protective casing according to claim 1 claim wherein the low-density core material between the inner and outer skins is selected from the group comprising: PVC foam; polyurethane foam material;

balsa wood; and cork.

7. A protective casing according to claim 6 wherein the foam core materials also contain filler material selected from the group comprising: particulate mineral; ceramic; and, glass.

8. A protective casing according to claim 6 wherein the foam is a high density syntactic foam.

9. A protective casing according to claim 1 further including cradle members to allow for the convenient stacking and handling of the casing and contained cylinders during transportation and storage.

10. A protective casing according to claim 1 wherein there are two casing members.

11. A protective casing according to claim 1 wherein faces of the at least two casing members which constitute the joint faces therebetween are provided with seal members.

12. A protective casing according to claim 11 wherein the joint faces are provided with intumescent seals.

13. A protective casing according to claim 1 further including an additional protective outer layer comprising a polyurethane coating.

14. A protective casing according to claim 10 wherein the casing members are of generally semi-cylindrical form and the assembled casing is of generally cylindrical form.

15. A protective casing according to claim 1 adapted for the protection of a cylinder containing uranium hexafluoride.

16. A protective casing according to claim 9 wherein the cradle members are fixed to said casino with mechanical fixing members.

17. A protective casing according to claim 9 wherein the cradle members are bonded to the casing.

18. A protective casing according to claim 1 wherein the inner surface of the inner skin is provided with elastomeric seating members.

19. A protective casing according to any one preceding claim wherein the outer and inner skins form a continuous surface enclosing the low density core material.

20. A protective casing according to claim 3 wherein the inner casing skin also includes local areas reinforced with aramid fiber.

21. A protective casing according to either claim 3 or wherein the inner skin also has reinforcing matal plates.

* * * * *

UNITED STATES PATENT AND TRADEMARK OFFICE

CERTIFICATE OF CORRECTION

PATENT NO. : 6,805,253 B1
DATED : October 19, 2004
INVENTOR(S) : Nicholson et al.

It is certified that error appears in the above-identified patent and that said Letters Patent is hereby corrected as shown below:

Title page,
Item [*] Notice, delete “178” and insert -- 587 --.

Signed and Sealed this

Thirtieth Day of August, 2005

JON W. DUDAS
*Director of the United States Patent and Trademark Office*